US009512657B2

(12) United States Patent
Yeung

(10) Patent No.: US 9,512,657 B2
(45) Date of Patent: Dec. 6, 2016

(54) HORIZONTAL PUSHED ALUMINUM ALLOY WINDOW WITH ANTI-FALLING MECHANISMS

(71) Applicant: LIP HING YEUNG'S INDUSTRIES (SHENZHEN) CO., LTD, Shenzhen, Guangdong (CN)

(72) Inventor: Chunghon Yeung, Shenzhen (CN)

(73) Assignee: LIP HING YEUNG'S INDUSTRIES (SHENZHEN) CO., LTD. (CN)

( * ) Notice: Subject to any disclaimer, the term of this patent is extended or adjusted under 35 U.S.C. 154(b) by 0 days.

(21) Appl. No.: 14/357,329

(22) PCT Filed: Nov. 5, 2013

(86) PCT No.: PCT/CN2013/086569

§ 371 (c)(1),
(2) Date: May 9, 2014

(87) PCT Pub. No.: WO2014/173104

PCT Pub. Date: Oct. 30, 2014

(65) Prior Publication Data

US 2016/0047154 A1 Feb. 18, 2016

(30) Foreign Application Priority Data

Apr. 25, 2013 (CN) ..... 2013 1 0147312

(51) Int. Cl.
*E05D 15/30* (2006.01)
*E05F 11/08* (2006.01)
(Continued)

(52) U.S. Cl.
CPC ..... *E05D 15/30* (2013.01); *E05D 15/44* (2013.01); *E05F 11/08* (2013.01); *E05F 11/16* (2013.01); *E06B 1/18* (2013.01); *E06B 3/5018* (2013.01); *E05Y 2600/50* (2013.01)

(58) Field of Classification Search
CPC ..... E05F 11/08; E05F 11/16; E05F 11/18; E05F 11/20; E05F 11/22; E06B 3/341; E06B 3/5018; E05D 15/30; E05D 5/0238; E05D 15/44
See application file for complete search history.

(56) References Cited

U.S. PATENT DOCUMENTS 4,034,513 A * 7/1977 Richardson ..... E06B 1/18 49/504
4,484,411 A * 11/1984 Rystad ..... E06B 1/18 49/505

(Continued)

FOREIGN PATENT DOCUMENTS

CN 2417267 Y 1/2001
CN 101089353 A 12/2007

(Continued)

OTHER PUBLICATIONS

International Search Report for PCT/CN2013/086569.

*Primary Examiner* — Brian Mattei
*Assistant Examiner* — Catherine A Kelly
(74) *Attorney, Agent, or Firm* — Garcia-Zamor IP Law; Ruy M. Garcia-Zamor

(57) ABSTRACT

A horizontal pushed aluminum alloy window includes a first mounting member, and a second mounting member. The first mounting member includes a first mounting surface, and the second mounting member includes a second mounting surface. The first mounting member includes a first fixing plate, a first sliding plate, and a pair of opposite first anti-falling ribs extruding from the first fixing plate and the first sliding plate. The second mounting member includes a second fixing plate, a second sliding plate, and a pair of opposite second anti-falling ribs extruding from the second fixing plate and the second sliding plate. The first mounting surface, the first fixing plate, the first sliding plate, and the first anti-falling ribs surrounds a first connecting groove, and second mounting surface, the second fixing plate, the second sliding plate, and the second anti-falling ribs surrounds a second connecting groove.

4 Claims, 11 Drawing Sheets

(51) Int. Cl.

| | |
|---|---|
| ***E05F 11/16*** | (2006.01) |
| ***E06B 1/18*** | (2006.01) |
| ***E06B 3/50*** | (2006.01) |
| ***E05D 15/44*** | (2006.01) |

(56) References Cited

U.S. PATENT DOCUMENTS

| | | | | |
|---|---|---|---|---|
| 7,082,727 | B2 * | 8/2006 | Schmidt | E06B 1/18 49/308 |
| 7,644,538 | B2 * | 1/2010 | Balbo Di Vinadio | E05C 9/063 49/192 |
| 7,690,154 | B2 * | 4/2010 | Muir | E05D 15/44 49/246 |
| 8,468,656 | B2 * | 6/2013 | Bauman | E05D 15/30 16/199 |
| 8,528,255 | B2 * | 9/2013 | Lambertini | E05C 9/063 49/192 |
| 8,683,746 | B2 * | 4/2014 | Lambertini | E05F 11/16 49/246 |
| 9,228,337 | B2 * | 1/2016 | Chong | E04B 1/24 |
| 2007/0245648 | A1 * | 10/2007 | Hoffmann | E05D 5/0238 52/204.5 |
| 2008/0016778 | A1 * | 1/2008 | Muir | E05D 5/0215 49/345 |
| 2013/0198997 | A1 * | 8/2013 | Olson | E05D 15/30 16/364 |

FOREIGN PATENT DOCUMENTS

| | | | |
|---|---|---|---|
| CN | 201137414 | Y | 10/2008 |
| CN | 201137415 | Y | 10/2008 |
| FR | 2476199 | | 8/1981 |
| GB | 2274302 | A | 7/1994 |
| WO | WO2005026485 | | 3/2005 |

* cited by examiner

HORIZONTAL PUSHED ALUMINUM ALLOY WINDOW WITH ANTI-FALLING MECHANISMS

CROSS REFERENCE TO RELATED APPLICATIONS

This application claims priority to the following patent applications: (1) Patent Cooperation Treaty Application PCT/CN2013/086569, filed Oct. 1, 2011; and (2) Chinese Patent Application CN 201310147312.0, filed Apr. 25, 2013; each of the above cited applications is hereby incorporated by reference herein as if fully set forth in its entirety.

BACKGROUND

1. Technical Field

The present disclosure generally relates to windows, and especially to a horizontal pushed aluminum alloy window with anti-falling mechanisms.

2. Description of Related Art

The window is an essential structure for a normal residential or commercial use building, used as ventilation and lighting purposes. Along with the progress of the society, beautiful appearance and good lighting aluminum alloy windows are generally be applied to every corner of the world. Although the aluminum alloy windows have various different structure designs, the horizontal pushed aluminum alloy window is a type of very wide range of applications, because the horizontal pushed aluminum alloy window has distinguishing feature of the small occupied area, achieving the whole window open, and not occupying the indoor space.

With application of the horizontal pushed aluminum alloy window as described above, the use of security problem of the aluminum alloy windows with hinge mechanisms has gained widely attention of people. Traditionally, horizontal pushed aluminum alloy window comprises a window frame, a window sash embedded with glass, and hinge mechanisms connecting the window frame to the window sash. A guiding rail of the hinge mechanism is mounted to a first mounting member of the window frame by screws or rivets, and a supporting arm of the hinge mechanism is mounted a second mounting member of the window sash by screws or rivets. The window sash can be horizontally pushed so that the aluminum alloy window is in an open position. Because the guiding rail is mounted to the window frame by screws or rivets, and the supporting arm is mounted to the window sash by screws or rivets, when the window sash is in the open position, the weight of the horizontal pushed aluminum alloy window is next to the hinge mechanism so that a torsion force applies to the hinge mechanism when wind applies to the aluminum alloy window, resulting in the screws or rivets disengaging from the window sash and/or the window frame and accidental fall of the aluminum alloy window. Furthermore, with the increase of service life, the screws or rivets is exposed to air year after year, there will be rust or loose in the screws or rivets, resulting in easy disengagement between the hinge mechanism and the window frame and/or between the hinge mechanism and the window sash.

In conclusion, the need to design a new aluminum alloy window, to solve connecting strength between the hinge mechanism and the fixed window frame and the window sash, improving the durability and security features, and this is the theme of the study.

SUMMARY

The present invention offers a horizontal pushed aluminum alloy window with anti-falling mechanisms to solve the problem that in the horizontal pushed traditional aluminum alloy window, the hinge mechanisms are connected to the window frame and the window sash by the screws or rivets so that the screws or rivets must bear the weight of the window sash and glass and the torsion force applied by the wind, resulting in the screws or rivets disengaging from the window sash and the window frame. Furthermore, with the increase of service life, the screws or rivets will be rust or loose, resulting in the screws or rivets disengaging from the window sash and the window frame.

In order to solve the problem, the present invention offers technical proposals as follow.

A horizontal pushed aluminum alloy window with anti-falling mechanisms includes a window frame, a window sash embedded in the window frame, and a pair of hinge mechanisms connecting the hinge mechanisms to the window frame, the hinge mechanisms comprising a flat strip guiding rail and a flat strip supporting arm, the window frame comprises a first mounting member comprising a first mounting surface located an inner side of the window frame, the window sash comprising a second mounting member corresponding to the first mounting member and comprising a second mounting surface located an outer side of the second mounting member and corresponding to the first mounting surface, the first mounting member comprising a first fixing plate and a first sliding plate corresponding to the first fixing plate, the first fixing plate comprising a first anti-falling rib extending from a side of one end of the first fixing plate face to the first sliding plate, the first sliding plate comprising a first anti-falling rib extending from a side of one end of the first sliding plate face to the first fixing plate and corresponding to the first anti-falling rib of the first sliding plate, the first sliding plate, the first anti-falling rib of the first sliding plate, the first fixing plate, the first anti-falling rib of the first fixing plate, and the first mounting surface surrounding a T-shaped first mounting groove, the second mounting member comprising a second fixing plate and a second sliding plate corresponding to the second fixing plate, the second fixing plate comprising a second anti-falling rib extending from a side of one end of one end of the second fixing plate face to the second sliding plate, the second sliding plate comprising a second anti-falling rib extending from a side of one end of the second sliding plate face to the second fixing plate and corresponding to the second anti-falling rib of the second sliding plate, the second sliding plate, the second anti-falling rib of the second sliding plate, the second fixing plate, the second anti-falling rib of the second fixing plate, and the second mounting surface surrounding a T-shaped second mounting groove, the first sliding plate comprising a first limiting portion vertically extending from another end of the first sliding plate, the first mounting member defining a first connecting groove and a first limiting groove, the first sliding plate being received in the first connecting groove, the first limiting portion being movably received in the first limiting groove, the second sliding plate comprising a second limiting portion vertically extending from a side of the second sliding plate, the second mounting member defining a second connecting groove and a second limiting groove in communication with the second connecting groove, the second sliding plate received in the second connecting groove, the second limiting portion movably received in the second limiting groove, a width of the first limiting portion being smaller than a width of the first limiting groove, a width of the first connecting groove being greater than a sum of a width of the first anti-falling rib of the first fixing plate and a width of the first anti-falling rib of the first sliding plate, a width of the second limiting portion being smaller than a width of the second limiting groove, a width of the second connecting groove being greater than a sum of a width of the second anti-falling rib of the second fixing plate and a width of the second anti-falling rib of the second sliding plate, the first mounting member comprising a first firming portion inserted into the first connecting groove between the first sliding plate and an inner wall of first connecting groove, the second mounting member comprising a second firming portion inserted into the second connecting groove between the second sliding plate and an inner wall of second connecting groove, wherein the guiding rail is received in the first mounting groove, and the supporting arm is received in the second mounting groove.

Preferably, the guiding rail comprises a first locating plate, and the first mounting member comprises a pair of first cutouts extending through the first anti-falling ribs; the supporting arm comprises a second locating plate, and the second mounting member comprises a pair of second cutouts extending through the second anti-falling ribs, wherein the first locating plate is received in the first cutouts, and the second locating plate is received in the second cutouts.

Preferably, the first fixing plate and the first sliding plate both are vertical to the first mounting surface, and a width of the limiting groove is greater than a width of the first limiting portion.

Preferably, the first mounting member comprises a strip projection portion adjacent to the first sliding plate, and a sidewall of the strip projection portion is a inner wall of the first connecting groove; the first firming portion comprises a first panel, a first firming head vertically extend from a surface of the first panel and comprising a plurality of barbs extruding from an inner wall of the first firming head face to the first hook portion, and a first hook portion vertically extend from the surface of the first panel, wherein the projecting portion is received in a space between the first firming head and the first hook portion, the first firming head is received in the first connecting groove between the first sliding plate and the projecting portion, and the first panel abuts against the projecting portion with the first hook portion hooks a side of the projecting portion apart from the first sliding plate, wherein the projecting portion defines a first recess corresponding to the hook portion, and the hook portion is received in the first recess.

Preferably, the second firming portion comprises a second firming head, a second panel, and a second hook extruding from a sidewall of the second firming head adjacent to the second panel, and an inner wall of the second fastening groove defines a second recess, wherein the second firming head is received in the second fastening groove between the second sliding plate and an inner wall of the second connecting groove, and the second hook is received in the second recess groove.

Preferably, the window frame and the window sash are rectangular frame, and the horizontal pushed aluminum alloy window with anti-falling mechanisms comprises two parallel the hinge mechanisms, wherein the window frame comprises two parallel the first mounting members, and the window sash comprises two the second mounting members, wherein each of the hinge mechanisms connected each of the first mounting members to each of the second mounting members.

Compared to the prior art, the present invention offers beneficial effect as follow:

1. Because the guiding rail is received first mounting groove, and the supporting arm is received second mounting grove, the screws or rivets are not used to connect the hinge mechanism to the window frame and the window sash to avoid the screws or rivets disengaging from the window sash and/or the window frame, increasing security of the horizontal pushed aluminum alloy window with anti-falling mechanisms;

2. The guiding rail is fastened by the first anti-falling ribs, and the supporting is fastened by the second anti-falling ribs, so that the focus area is increased, the pressure force is reduced, the mechanical damage of the hinge mechanism and the first and second mounting grooves are effectively reduced, the support arm on the supporting arm and the guiding rail are increased, and the weight born by the hinge mechanism is increased, further increase security of the horizontal pushed aluminum alloy window with anti-falling mechanisms;

3. Because the first firming portion is inserted into the first connecting groove between the first sliding plate and an inner wall of first connecting groove to prevent the guiding rail from disengaging from the first mounting groove, and the second firming portion is inserted into the second connecting groove between the second sliding plate and an inner wall of second connecting groove to prevent supporting arm from disengaging from the second mounting groove, different size of the first firming portion can fasten different size of the guiding rail in the first mounting groove, and different size of the second firming portion can fasten different size of the supporting arm in the second mounting groove, increasing flexibility of use at the same time not to lose the anti-falling function.

DETAILED DESCRIPTION

Figure 1:
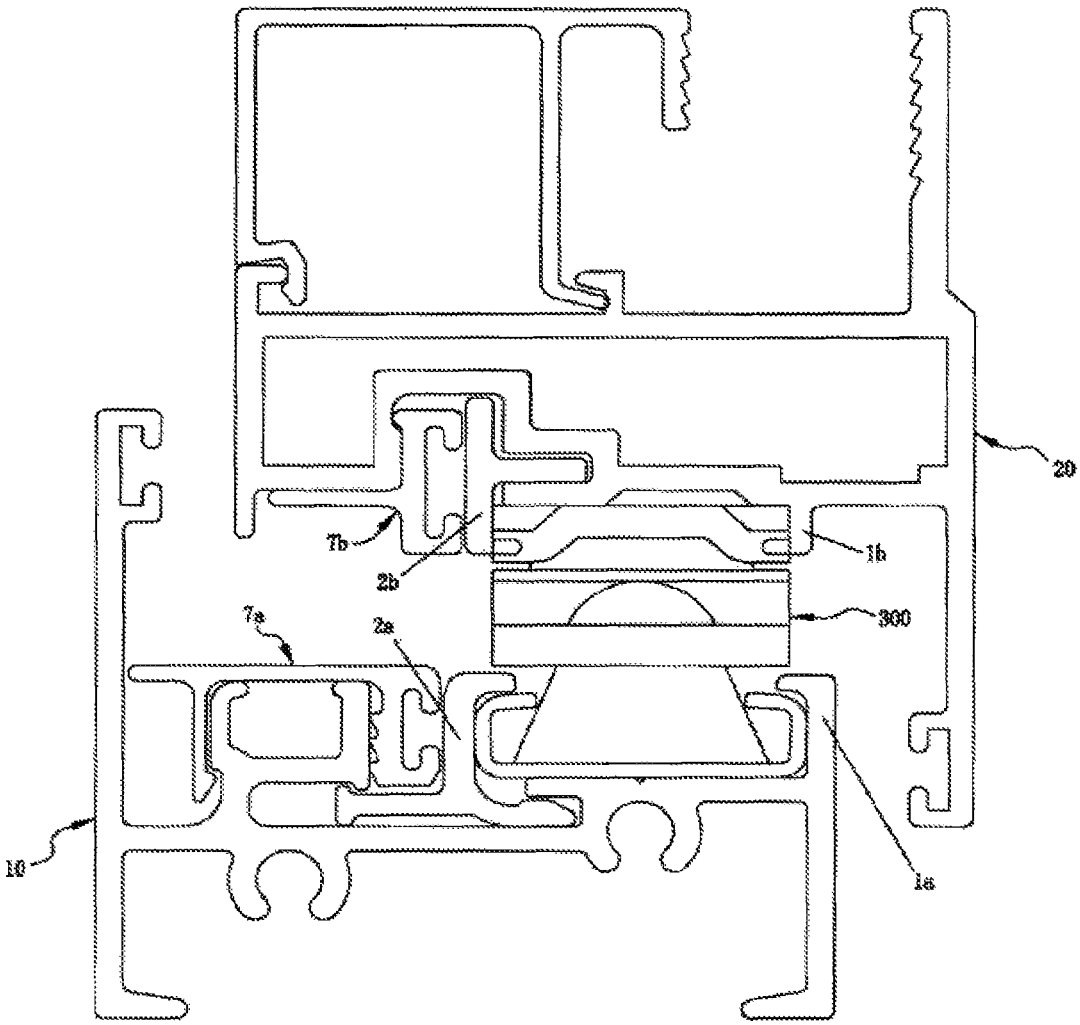
FIG. 1 is a sectional view of a window of an exemplary embodiment according to the present disclosure.

The following will be combined with the FIGS. 1 to 9 as well as the preferred embodiment of the present invention to describe in detail the horizontal pushed aluminum alloy window with anti-falling mechanisms of the present invention.

With reference to FIGS. 1 to 4, the present invention offers a horizontal pushed aluminum alloy window with anti-falling mechanisms. The horizontal pushed aluminum alloy window with anti-falling mechanisms comprises a window frame 100, a window sash 200 embedded in the window frame 100, and a horizontal pushed hinge mechanism 300 connecting the window frame 100 to the window sash 200. The hinge mechanism 300 comprises a flat strip guiding rail 301 and a flat strip supporting arm 302. The window frame 100 comprises a first mounting member 10. The first mounting member 10 comprises a first mounting surface 11 located an inner side of the window frame 100. The window sash 200 comprises a second mounting member 20 corresponding to the first mounting member 10. The second mounting member 20 comprises a second mounting surface 21 located an outer side of the second mounting member 20 and corresponding to the first mounting surface 11. The first mounting member 10 comprises a first fixing plate 1*a* and a first sliding plate 2*a* corresponding to the first fixing plate 1*a*. The first fixing plate 1*a* comprises a first anti-falling rib 3*a* extending from a side of one end of the first fixing plate 1*a* face to the first sliding plate 2*a*, and the first sliding plate 2*a* comprises a first anti-falling rib 3*a* extending from a side of one end of the first sliding plate 2*a* face to the first fixing plate 1*a* and corresponding to the first anti-falling rib 3*a* of the first sliding plate 2*a*. A first mounting groove 12 is surrounded by the first sliding plate 2*a*, the first anti-falling rib 3*a* of the first sliding plate 2*a*, the first fixing plate 1*a*, the first anti-falling rib 3*a* of the first fixing plate 1*a*, and the first mounting surface 11. The second mounting member 20 comprises a second fixing plate 1*b* and a second sliding plate 2*b* corresponding to the second fixing plate 1*b*. The second fixing plate 1*b* comprises a second anti-falling rib 3*b* extending from a side of one end of one end of the second fixing plate 1*b* face to the second sliding plate 2*b*, and the second sliding plate 2*b* comprises a second anti-falling rib 3*b* extending from a side of one end of the second sliding plate 2*b* face to the second fixing plate 1*b* and corresponding to the second anti-falling rib 3*b* of the second sliding plate 2*b*. A second mounting groove 22 is surrounded by the second sliding plate 2*b*, the second anti-falling rib 3*b* of the second sliding plate 2*b*, the second fixing plate 1*b*, the second anti-falling rib 3*b* of the second fixing plate 1*b*, and the second mounting surface 21. In one embodiment, the first mounting groove 12 and the second mounting groove 22 are T-shaped. The first sliding plate 2*a* comprises a first limiting portion 5*a* extending from another end of the first sliding plate 2*a*. The first mounting member 10 defines a first connecting groove 4*a* and a first limiting groove 6*a* in communication with the first connecting groove 4*a*. The first sliding plate 2*a* is received in the first connecting groove 4*a*, and the first limiting portion 5*a* is movably received in the first limiting groove 6*a*. In one embodiment, the first sliding plate 2*a* is vertical to the first limiting portion 5*a*, and a width of the first limiting portion 5*a* is smaller than a width of the first limiting groove 6*a*. A width of the first connecting groove 4*a* is greater than a sum of a width of the first anti-falling rib 3*a* of the first fixing plate 1*a* and a width of the first anti-falling rib 3*a* of the first sliding plate 2*a*. The second sliding plate 2*b* comprises a second limiting portion 5*b* extending from a side of the second sliding plate 2*b*. The second mounting member 20 defines a second connecting groove 4*b* and a second limiting groove 6*b* in communication with the second connecting groove 4*b*. The second sliding plate 2*b* is received in the second connecting groove 4*b*, and the second limiting portion 5*b* is movably received in the second limiting groove 6*b*. In one embodiment, the second sliding plate 2*b* is vertical to the second limiting portion 5*b*, and a width of the second limiting portion 5*b* is smaller than a width of the second limiting groove 6*b*. A width of the second connecting groove 4*b* is greater than a sum of a width of the second anti-falling rib 3*b* of the second fixing plate 1*b* and a width of the second anti-falling rib 3*b* of the second sliding plate 2*b*. A first firming portion 7*a* is inserted into the first connecting groove 4*a* between the first sliding plate 2*a* and an inner wall of first connecting groove 4*a*. A second firming portion 7*b* is inserted into the second connecting groove 4*b* between the second sliding plate 2*b* and an inner wall of second connecting groove 4*b*. The guiding rail 301 is received in the first mounting groove 12, and the supporting arm 302 is received in the second mounting groove 22.

Referring to FIGS. 4 to 9, the guiding rail 301 comprises a first locating plate 303*a*. The first fixing plate 1*a* defines a first cutout 304*a* extending through the first anti-falling rib 3*a* thereof, and the first sliding plate 2*a* defines a first cutout 304*a* extending through the first anti-falling rib 3*a* thereof. The first cutout 304*a* defined in the first fixing plate 1*a* and the first cutout 304*a* defined in the first sliding plate 2*a* are formed a pair of first cutouts 304*a*. The first locating plate 303*a* is received in the pair of first cutouts 304*a*. The supporting arm 302 comprises a second locating plate 303*b*. The second fixing plate 1*b* defines a second cutout 304*b* extending through the second anti-falling rib 3*b* thereof, and the second sliding plate 2*b* defines a second cutout 304*b* extending through the second anti-falling rib 3*b* thereof. The second cutout 304*b* defined in the second fixing plate 1*b* and the second cutout 304*b* defined in the second sliding plate 2*b* are formed a pair of second cutouts 304*a*. The second locating plate 303*b* is received in the pair of second cutouts 304*b*.

Figure 2:
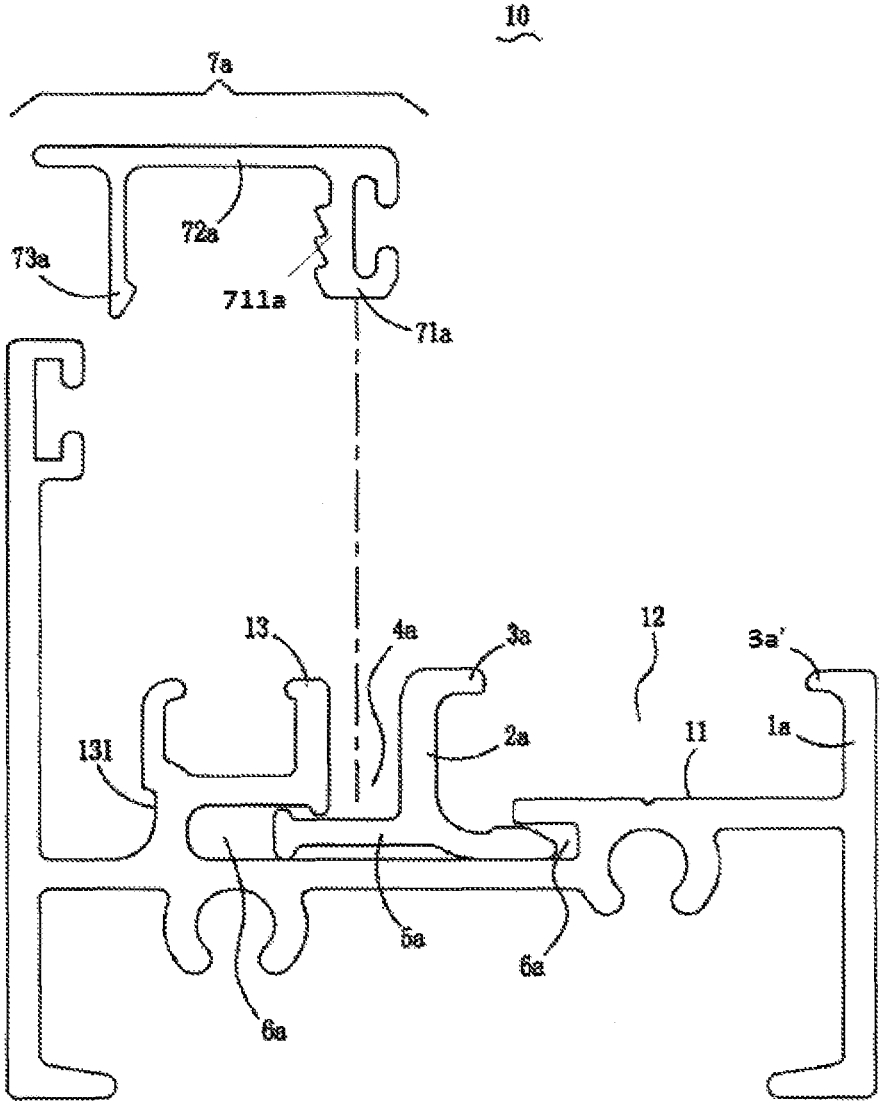
FIG. 2 is a sectional view of a first mounting member of the window of FIG. 1.

Referring to FIGS. 1 and 2, in one embodiment, the first fixing plate 1*a* is vertical to the first mounting surface 11, and first sliding plate 2*a* is vertical to the first mounting surface 11. The first anti-falling rib 3*a* extends from a side of one end of the first fixing plate 1*a* face to the first sliding plate 2*a* and opposite to the first mounting surface 11, and the first anti-falling rib 3*a* face to the first anti-falling rib 3*a* of the first sliding plate 2*a* extends from a side of one end of the first sliding plate 2*a* face to the first fixing plate 1*a* and opposite to the first mounting surface 11. The first sliding plate 2*a* is vertical to the first limiting portion 5*a*. An inner wall of the first connecting groove 4*a* defines the first limiting groove 6*a* corresponding to the first limiting portion 5*a*, and the first limiting portion 5*a* is slidably received in the first limiting groove 6*a*. A width of the limiting groove 6*a* is greater than a width of the first limiting portion 5*a*.

Referring to FIG. 2, in one embodiment, the first mounting member 10 comprises a strip projection portion 13 adjacent to the first sliding plate 2*a*, a sidewall of the strip projection portion 13 is a inner wall of the first connecting groove 4*a*. The first firming portion 7*a* comprises a first firming head 71*a*, a first panel 72*a*, and a first hook portion 73*a*. The first firming head 71*a* and the first hook portion 73*a* vertically extend from a surface of the first panel 72*a* to the projecting portion 13. The projecting portion 13 is received in a space between the first firming head 71*a* and the first hook portion 73*a*. The first firming head 71*a* is received in the first connecting groove between the first sliding plate 2*a* and the projecting portion 13, and the first panel 72*a* abuts against the projecting portion 13 with the first hook portion hooks a side of the projecting portion 13 apart from the first sliding plate 2*a*. The first firming head 71*a* comprises a plurality of barbs 711*a* extruding from an inner wall of the first firming head 71*a* face to the first hook portion 73*a*. The projecting portion 13 defines a first recess 131 corresponding to the hook portion 73*a*. The hook portion 73*a* is received in the first recess 131.

Figure 3:
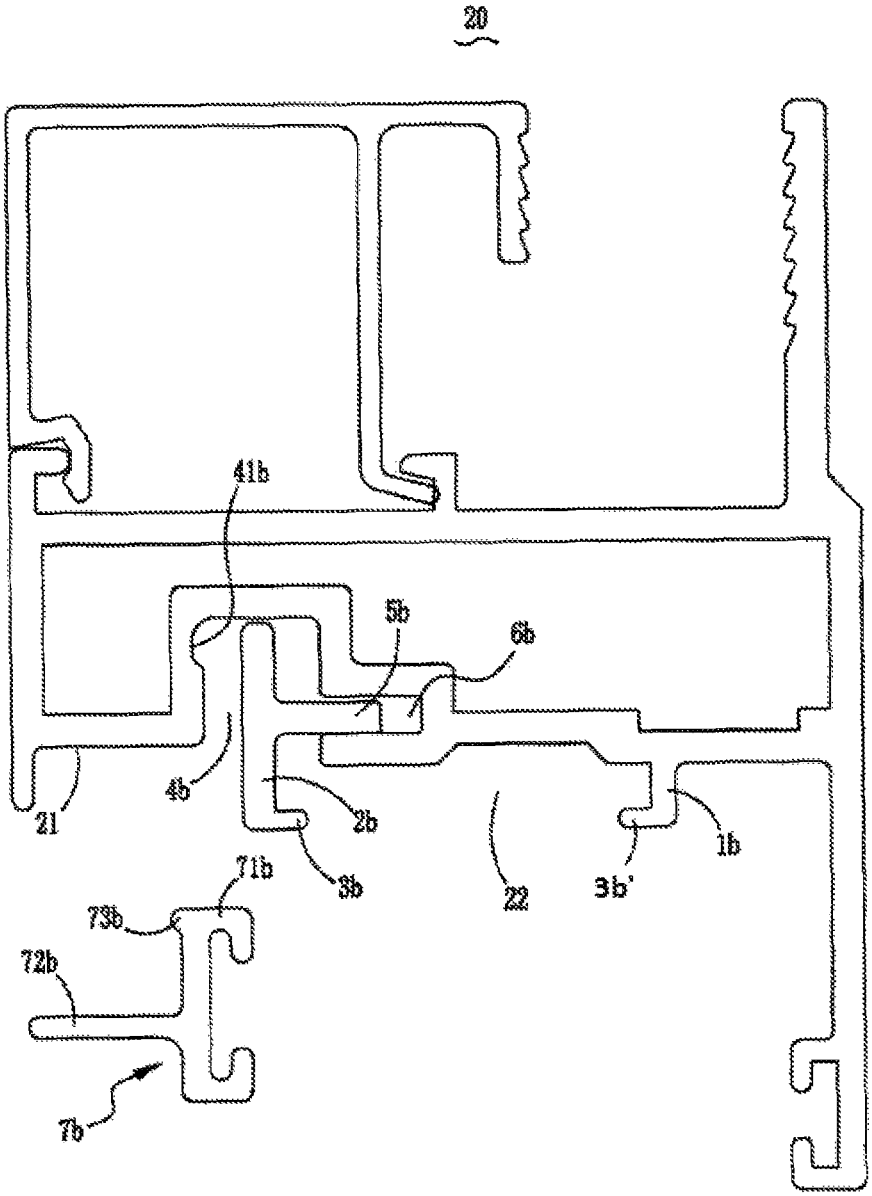
FIG. 3 is a sectional view of a second mounting member of the window of FIG. 1.
Figure 4:
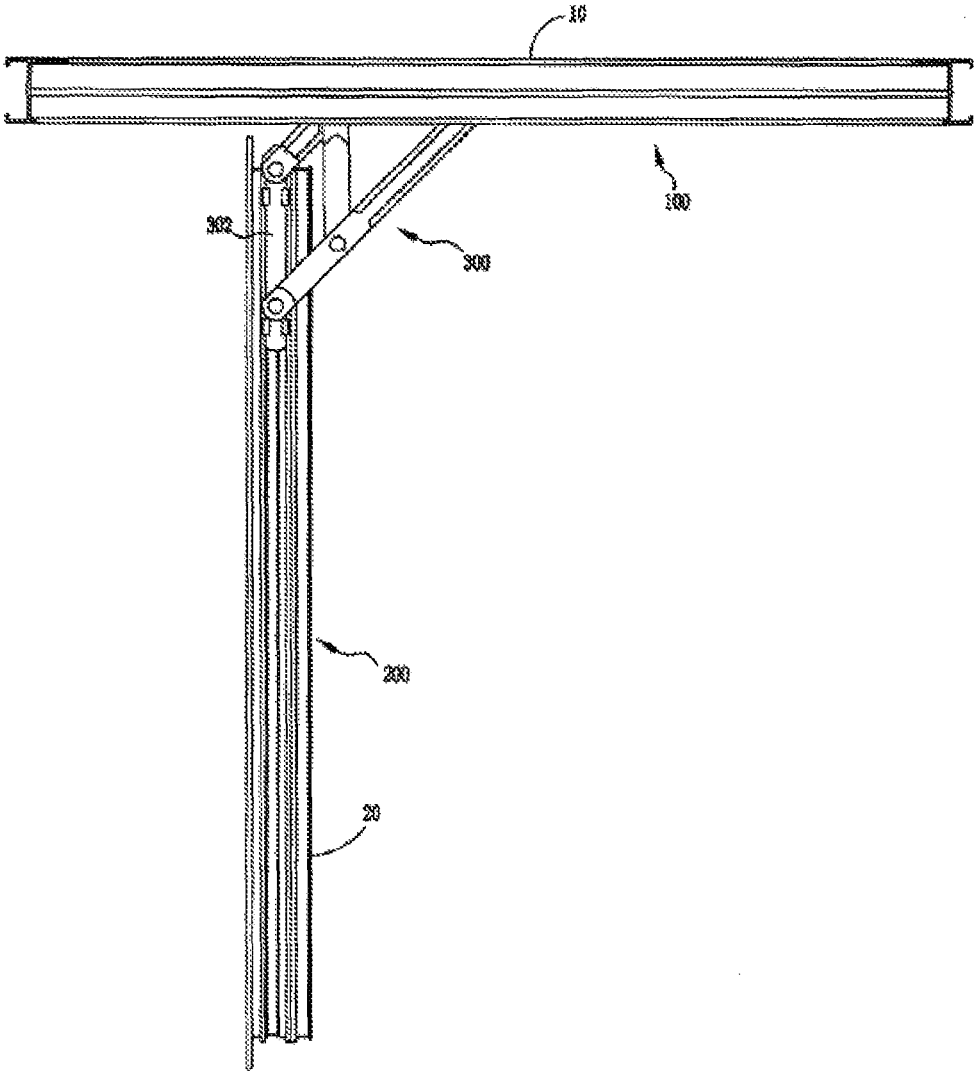
FIG. 4 is a schematic assembled view of the window of FIG. 1.
Figure 5:
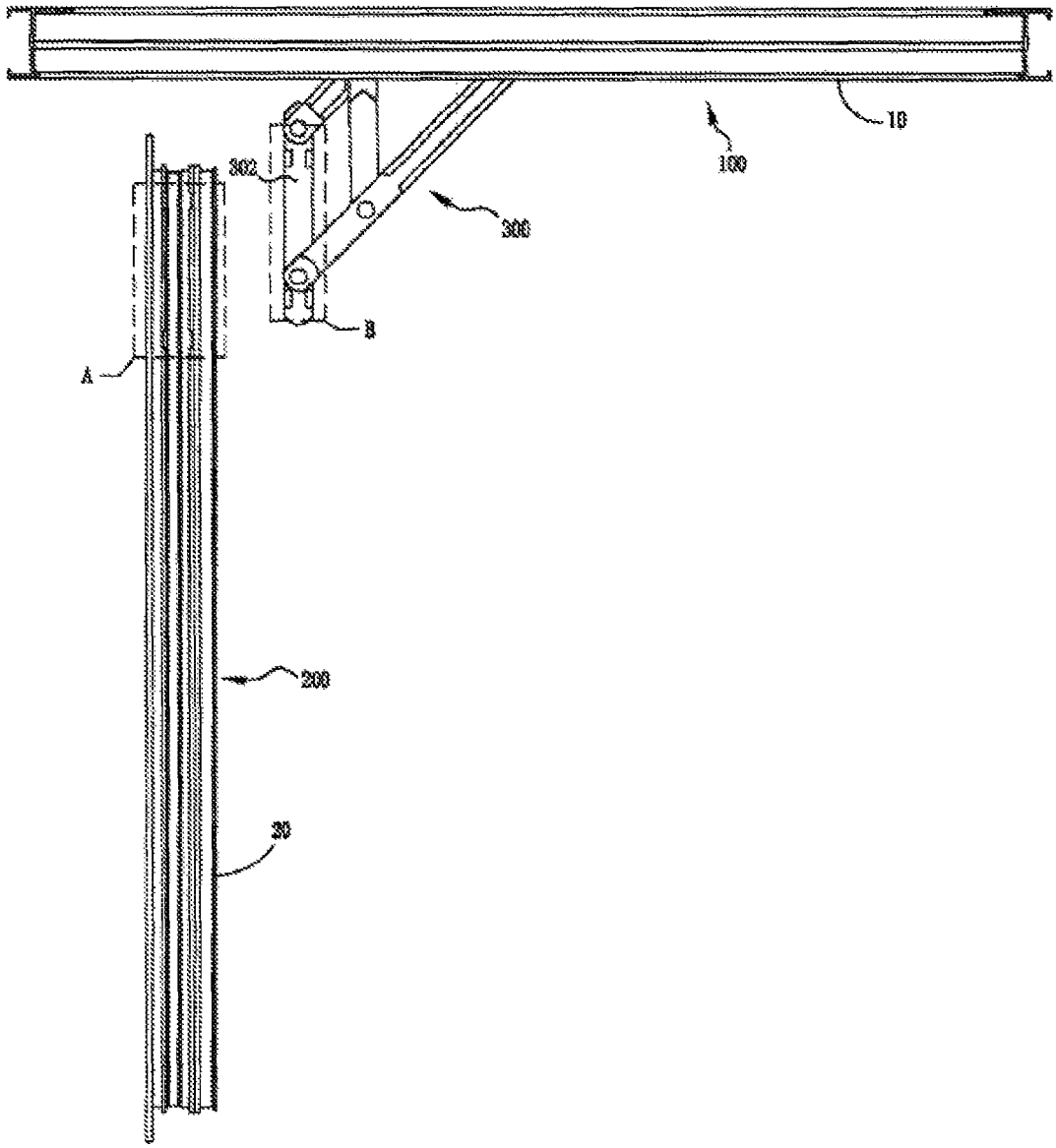
FIG. 5 is a schematic view of a window sash disengaged with a hinge mechanism of the window of FIG. 1.
Figure 6A:
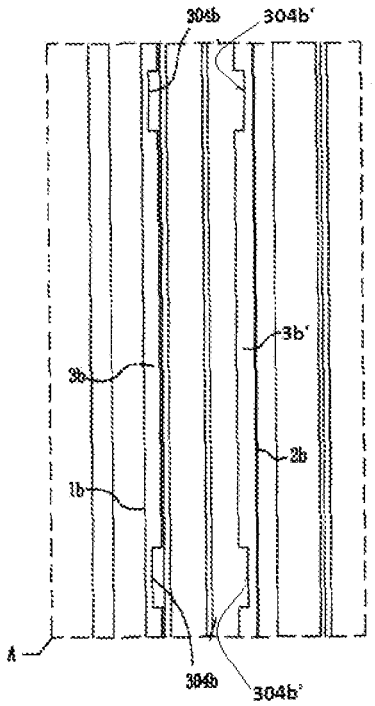
FIG. 6 is an enlarged view of rectangular portions A and B of FIG. 5.
Figure 6B:
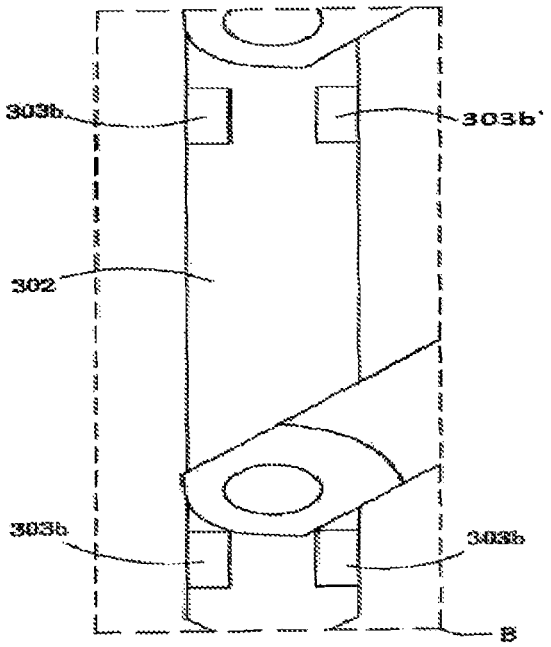
Figure 7:
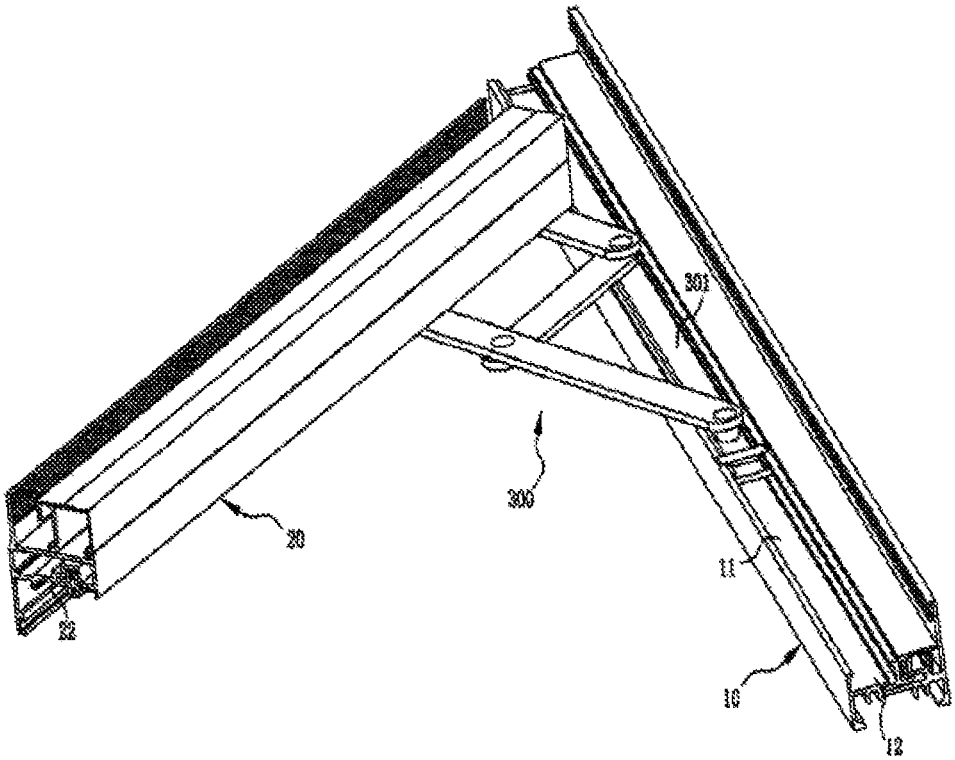
FIG. 7 is a schematic assembled view of the first mounting member and the second mounting member and the hinge mechanism of the window of FIG. 1.
Figure 8:
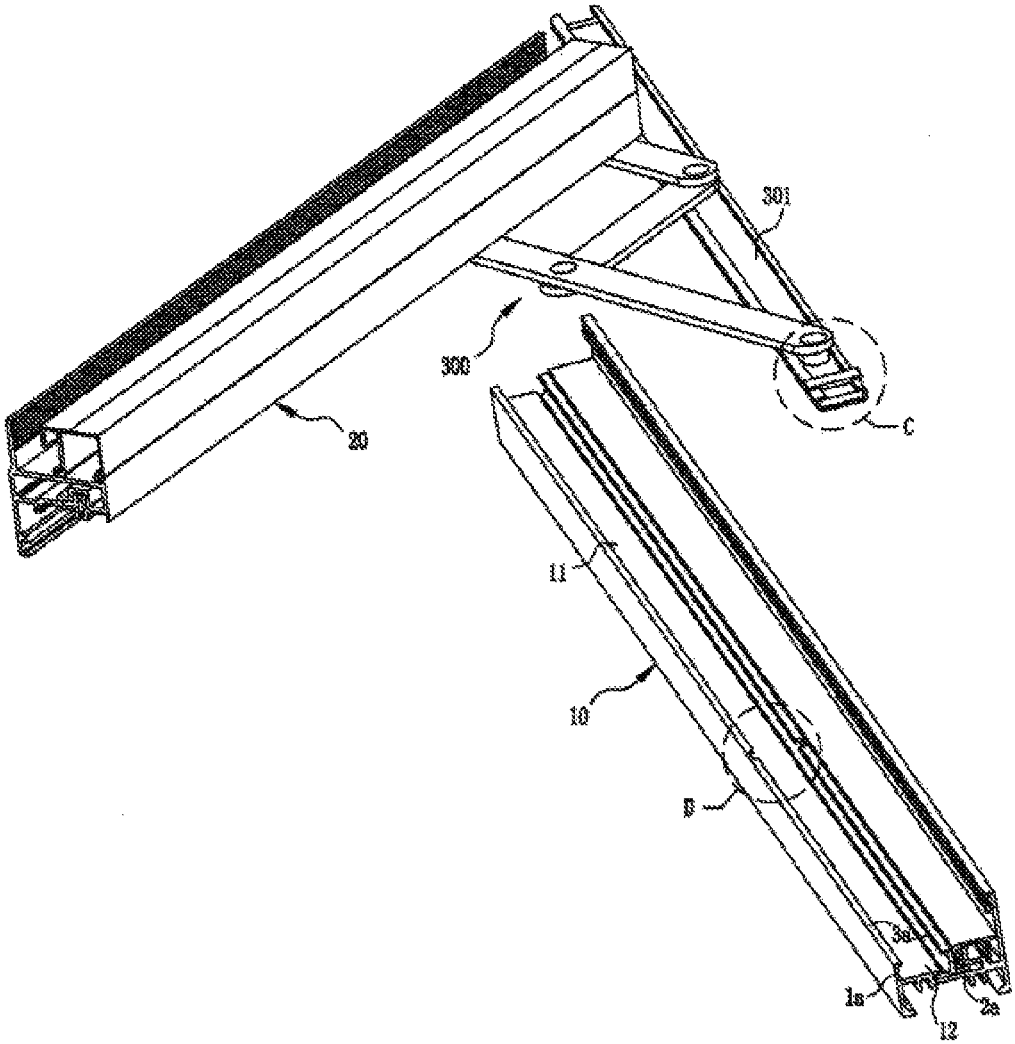
FIG. 8 is a schematic view of the first mounting member disengaged with a hinge mechanism of the window of FIG. 1.
Figure 9A:
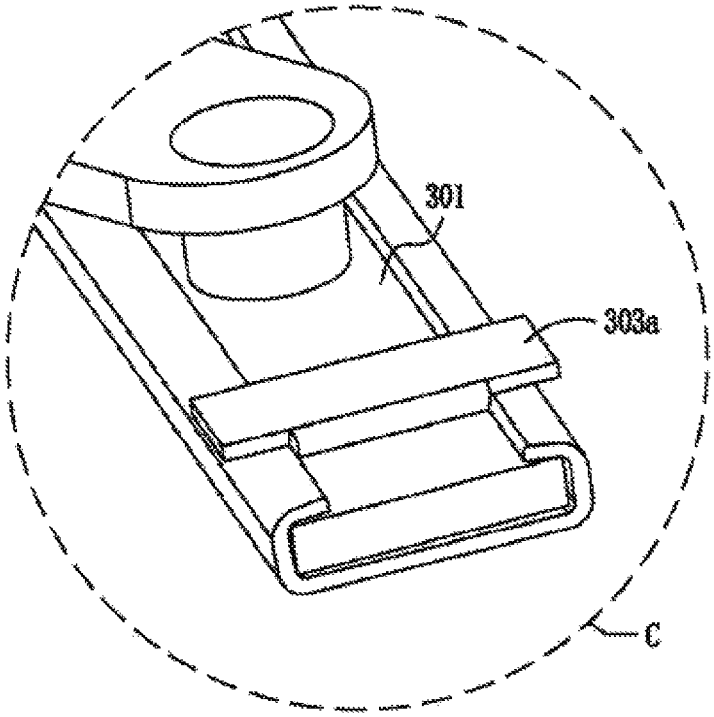
FIG. 9 is an enlarged view of circle portions C and D of FIG. 8.
Figure 9B:
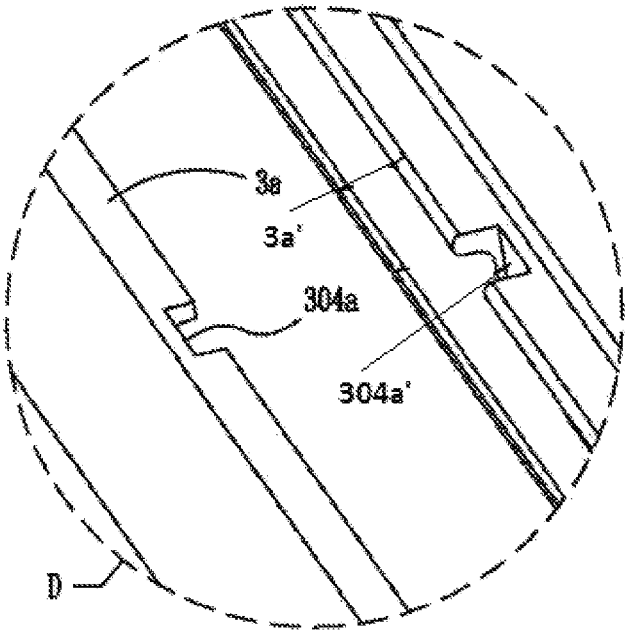

Referring to FIG. 3, in one embodiment, the second firming portion 7*b* comprises a second firming head 71*b*, a second panel 72*b*, and a second hook 73*b* extruding from a sidewall of the second firming head 71*b* adjacent to the second panel 72*b*. A second recess 41*b* corresponding to the second hook 73*b* is defined in an inner wall of the second connecting groove 4*b*. In assembly, the second firming head 71*b* is received in the second connecting groove 4*b* between the second sliding plate 2*b* and an inner wall of the second connecting groove 4*b*, and the second hook 73*b* is received in the second recess 41*b*.

In one embodiment, the window frame 100 and the window sash 200 are rectangular frame. The window comprises two parallel the hinge mechanisms 300. The window frame 100 comprises two parallel the first mounting members 10, and the window sash 200 comprises two the second mounting members 20. Each of the hinge mechanisms 300 connected each of the first mounting members 10 to each of the second mounting members 20.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A horizontal pushed aluminum alloy window with anti-falling mechanisms, comprising a window frame, a window sash embedded in the window frame, and a pair of hinge mechanisms connecting to the window frame, the hinge mechanisms comprising a flat strip guiding rail and a flat strip supporting arm, the window frame comprises a first mounting member comprising a first mounting surface located an inner side of the window frame; the window sash comprising a second mounting member corresponding to the first mounting member and comprising a second mounting surface located an outer side of the second mounting member and corresponding to the first mounting surface; the first mounting member comprising a first fixing plate and a first sliding plate corresponding to the first fixing plate, the first fixing plate comprising a first anti-falling rib extending from a side of one end of the first fixing plate facing toward the first sliding plate, the first sliding plate comprising a first anti-falling rib extending from a side of one end of the first sliding plate facing toward the first fixing plate and corresponding to the first anti-falling rib of the first fixing plate; the first sliding plate, the first anti-falling rib of the first sliding plate; the first fixing plate, the first anti-falling rib of the first fixing plate, and the first mounting surface surrounding a T-shaped first mounting groove; the second mounting member comprising a second fixing plate and a second sliding plate corresponding to the second fixing plate, the second fixing plate comprising a second anti-falling rib extending from a side of one end of one end of the second fixing plate facing toward the second sliding plate; the second sliding plate comprising a second anti-falling rib extending from a side of one end of the second sliding plate facing toward the second fixing plate and corresponding to the second anti-falling rib of the second fixing plate; the second sliding plate; the second anti-falling rib of the second sliding plate, the second fixing plate, the second anti-falling rib of the second fixing plate, and the second mounting surface surrounding a T-shaped second mounting groove; the first sliding plate comprising a first limiting portion vertically extending from another end of the first sliding plate, the first mounting member defining a first connecting groove and a first limiting groove, the first sliding plate being received in the first connecting groove, the first limiting portion being movably received in the first limiting groove; the second sliding plate comprising a second limiting portion vertically extending from a side of the second sliding plate, the second mounting member defining a second connecting groove and a second limiting groove in communication with the second connecting groove, the second sliding plate received in the second connecting groove, the second limiting portion movably received in the second limiting groove; a width of the first limiting portion being smaller than a width of the first limiting groove, a width of the first connecting groove being greater than a sum of a width of the first anti-falling rib of the first fixing plate and a width of the first anti-falling rib of the first sliding plate, a width of the second limiting portion being smaller than a width of the second limiting groove, a width of the second connecting groove being greater than a sum of a width of the second anti-falling rib of the second fixing plate and a width of the second anti-falling rib of the second sliding plate; the first mounting member comprising a first firming portion inserted into the first connecting groove between the first sliding plate and an inner wall of first connecting groove; the second mounting member comprising a second firming portion inserted into the second connecting groove between the second sliding plate and an inner wall of second connecting groove, wherein the guiding rail is received in the first mounting groove, and the supporting arm is received in the second mounting groove, wherein the first mounting member comprises a strip projection portion adjacent to the first sliding plate, and a sidewall of the strip projection portion is an inner wall of the first connecting groove, the inner wall of the first connecting groove being flat; the first firming portion comprises a first panel, a first firming head vertically extending from a surface of the first panel and comprising a plurality of barbs extruding from an inner wall of the first firming head face to the first hook portion, and a first hook portion vertically extending from the surface of the first panel, wherein the projecting portion is received in a space between the first firming head and the first hook portion, the first firming head is received in the first connecting groove between the first sliding plate and the projecting portion, the barbs of the first firming head directly abutting the flat inner wall of the first connecting groove, and the first panel abuts against the projecting portion with the first hook portion hooks a side of the projecting portion apart from the first sliding plate, wherein the projecting portion defines a first recess corresponding to the hook portion, and the hook portion is received in the first recess.

2. The horizontal pushed aluminum alloy window with anti-falling mechanisms of claim 1, wherein the guiding rail comprises a first locating plate, and the first mounting member comprises a pair of first cutouts extending through the first anti-falling ribs; the supporting arm comprises a second locating plate, and the second mounting member comprises a pair of second cutouts extending through the second anti-falling ribs, wherein the first locating plate is received in the first cutouts, and the second locating plate is received in the second cutouts.

3. The horizontal pushed aluminum alloy window with anti-falling mechanisms of claim 2, wherein the first fixing plate and the first sliding plate both are vertical to the first mounting surface, and a width of the limiting groove is greater than a width of the first limiting portion.

4. The horizontal pushed aluminum alloy window with anti-falling mechanisms of claim 3, wherein the second firming portion comprises a second firming head, a second panel, and a second hook extruding from a sidewall of the second firming head adjacent to the second panel, and an inner wall of the second fastening groove defines a second recess, wherein the second firming head is received in the second fastening groove between the second sliding plate and an inner wall of the second connecting groove, and the second hook is received in the second recess groove.

* * * * *